United States Patent [19]

Udagawa

[11] Patent Number: 4,609,363

[45] Date of Patent: Sep. 2, 1986

[54] TRACK TOY

[76] Inventor: Yoshio Udagawa, 3-13, 3-chome, Mama Ichikawa-shi, Chiba-ken, Japan

[21] Appl. No.: 718,356

[22] Filed: Apr. 1, 1985

[30] Foreign Application Priority Data

Feb. 9, 1985 [DE] Fed. Rep. of Germany ... 8503618[U]

[51] Int. Cl.[4] ..... A63H 18/00

[52] U.S. Cl. ..... 446/444; 446/171

[58] Field of Search ..... 446/171, 172, 168, 444, 446/236, 246, 265, 268, 314, 924, 491, 169; 104/53, 55, 56, 63

[56] References Cited

U.S. PATENT DOCUMENTS 1,274,979 8/1918 Bliley ..... 446/171
1,736,176 11/1929 Shepherd ..... 446/172
3,721,036 3/1973 Goldfarb ..... 446/314
4,128,964 12/1978 Ogasawara ..... 446/171
4,395,041 7/1983 Goldfarb et al. ..... 446/168 X

*Primary Examiner*—Mickey Yu

[57] ABSTRACT

The toy set includes a spiral track member mounted with respect to a larger toy robot, and there are two engaged gears mounted on the larger toy robot at positions substantially corresponding to the upper and lower ends of the track member, these gears are driven to rotate by a battery driven motor located within the larger toy robot. Several smaller robots placed on the lower end of the track member can be periodically conveyed therefrom to the upper end of the track member by the arms that are extended from the gears and rotated therewith.

8 Claims, 3 Drawing Figures

TRACK TOY

This invention relates to a track toy set and particularly concerns the new and useful improvements on a track toy set which performs a cyclical movement function.

An animated track toy means the toy that includes a track and several objects which perform movement associated with the track generally through the utilization of a battery driven motor. However, such animated toys are expensive and complex in construction. In this invention, a track toy set with simple and novel construction is disclosed, which is believed to be extremely attractive to young children.

The primary object of the invention is to provide a toy set including a spiral track associated with a gearing driving mechanism to make several toy elements periodically travel through the spiral track.

Another object of this invention is to provide a track toy with novel and interesting structure.

BRIEF DESCRIPTION OF THE INVENTION

According to the features of this invention, a track toy set includes a track member having an upper end and a lower end, a body mounted with respect to the track member; a first gear rotatably mounted to the body and located above the lower end of the track member, the first gear has a plurality of first axially extending arms peripherally disposed thereon and equally spaced from each other; a second gear rotatably mounted to the body at a higher position relative to the first gear and engaged with the first gear, the second gear has a same number of axially extending arms as that of the first gear and which are peripherally disposed thereon and equally spaced from each other; a driving mechanism housed within the body capable of driving the first gear and the second gear to rotate, with the rotation of the first gear and the second gear, the plurality of first axially extending arms periodically levelled with the plurality of second axially extending arms; and a wheeled toy member including a pair of opposite supporting members which member when placed on the lower end of the track is carried by one of said first axially extending arms to one of the second axially extending arms, and is then carried by the one of the second arms to the upper end of the track member.

The other features and improvements will become apparent as the description with reference to the drawings proceeds. In the accompanying drawings forming a part of this application:

DETAILED DESCRIPTION OF THE INVENTION

Figure 1:
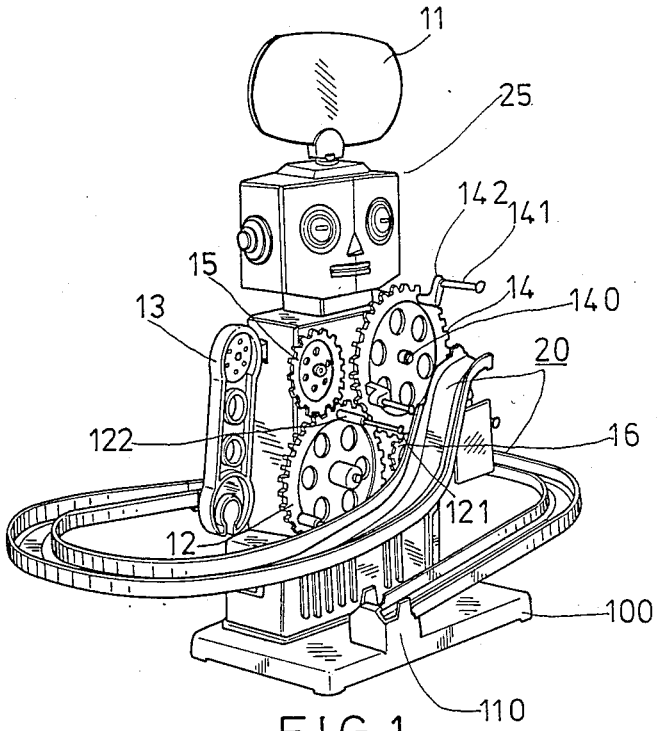
FIG. 1 is a perspective view of the track toy according to this invention.
Figure 2:
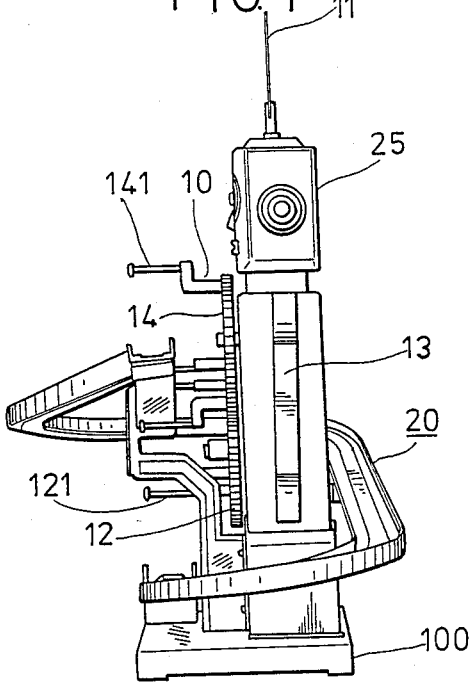
FIG. 2 is a right side view of the track toy as shown in FIG. 1.

Referring first to FIG. 1, the main parts of the track toy include a gearing driving unit 10 and a track member 20 spirally extending around the gearing driving unit 10.

Figure 3:
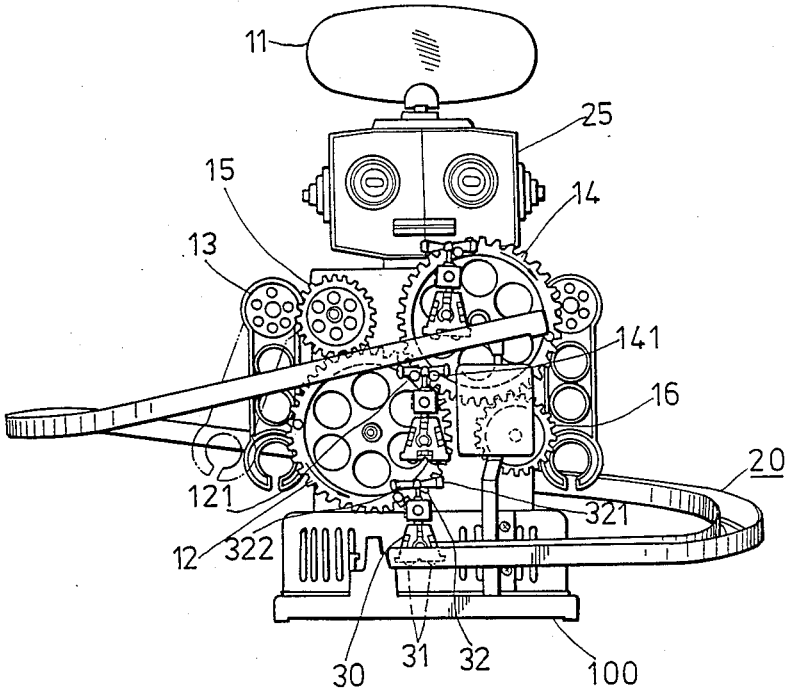
FIG. 3 is a schematic front view of the track toy as shown in FIG. 1.

The gearing driving unit 10 is arranged on the chest of a large upright toy robot 25 formed integrally with a base 100, comprising a first gear 12 and a second gear 14 located higher than the first gear 12 and engaged therewith. There are gear trains (not seen in the Figures) mounted within the larger robot 25 for driving the arms 13 thereof to swing left and right as shown in FIG. 3. The first gear 12 and second gear 14 are driven to rotate by an output shaft 140 of a driving motor housed in the hollow body of the larger robot 25.

In addition to the first and second gears 12 and 14, there are further provided two ornamental gears 15 and 16 of smaller sizes.

The radar 11 mounted on the head of the robot 25 is also rotated by the driving motor located internally in the robot 25.

A seat 110 formed on the base 100 is provided for supporting the lower end of the track member 20, the track member 20 is extended from the seat 110, following a spiral path, to the upper end thereof. The lower end is positioned lower than the first gear 12 and the upper end is positioned higher than the first gear 12.

There are three second axially extending arms 141 secured on the peripheral surface of the second gear 14 through three angled pieces 141 respectively, the angular distance of every two arms 141 is 120 degrees. Around the periphery of the first gear 12 there are also three first axially extending arms 121, the first axially extending arm 121 is secured on a cylindrical holding member 122 rather than the angled piece 142. The first extending arms 121 are also spaced from each other with an angular distance of 120 degrees. The lateral section of the angled piece 142 is of a certain length such that the distance between the second axially extending arm 141 and the first axially extending arm 121 is narrow enough when these two arms 121, 141 are rotated to become level with each other in the vicinity of the engaging teeth of the first gear 12 and second gear 14.

The relative position of the first gears 12 and second gear 14 is arranged such that the first axially extending arms 121 and the second axially extending arm 141 can be periodically levelled with each other, respectively, in the vicinity of the contact teeth of the two gears 12 and 14.

As can be seen in FIG. 3, in this embodiment, there are three smaller toy robots 30, there is a T-shaped supporting member 32 mounted on the head of each robot 30, the left and right section of the transverse portion of the T-shaped member 32 are formed with a curved lower edge respectively for acting as a retaining surface, whereby it can be retained on the surfaces of the first and second axially extending arms 141 and 121 in a sequence as will be described later.

The smaller robot 30 has wheels 31 mounted on the bottom thereof, so that it can slide on the track 20. The cyclical course of the smaller robot 30 begins at the lower end of the track 20. When the robot 30 is properly placed on the lower end of the track 20 and the gears 12 and 14 are driven to rotate, at the time when one of the extending arms 121 has rotated to a position beneath the left section 322 of the T-shaped supporting member 32, the robot 30 will be raised by the extending arm 121 through a path defined by the rotation of the gear 12, and because the extending arm 121 is engaged with the curved lower edge of the left section 322 of the T-shaped supporting member 32, the robot 30 will not fall off.

When the first extending arm 121, which bears the robot 30, is rotated to be horizontally parallel or level with a corresponding second extending arm 141 in the vicinity of the engaging teeth of the gears 12 and 14, the second extending arm 141 becomes directly positioned beneath the right section 321 of the transverse portion of the T-shaped supporting member 32, therefore, the second extending arm 141 receives the right section 321 as soon as the first extending arm 121 discharges the left section 322 of the transverse portion of the T-shaped supporting member 32. When the robot 30 is elevated to a height where its wheels 31 are placed on the sliding surface of the track 20, it will slide downwards over the track 20 until it reaches the lower end where it awaits another cycle of travel when the original axially extending arm 121 is rotated to position beneath the left section 322 of the transverse section of the T-shaped member 32.

The number of the first and second axially extending arms 121 and 141 correspond to the number of the smaller robots 30, and this arrangement, the first extending arm 121 which raises one of the robots 30 at the lower end of the track 20 turns one cycle back to the lower end of the track 20 at the same time the robot 30 completes its cycle of travelling and returns to the lower end of the track member 20, where it will be raised by the same first extending arm 121, and such cyclical movement continues as long as the driving unit 10 operates.

I claim:

1. A track toy set comprising:

a track member (20) having an upper end and a lower end;

a body (25) mounted with respect to said track member (20);

a first gear (12) rotatably mounted to said body (25) and located above said lower end of said track member (20), having a plurality of first axially extending arms (121) peripherally disposed thereon and equally spaced from each other;

a second gear (14) rotatably mounted to said body (25) at a higher position relative to said first gear (12) and engaged with said first gear (12), having a plurality of second axially extending arms (141) peripherally disposed thereon and equally spaced from each other;

a driving mechanism housed within said body (25) capable of driving said first gear (12) and said second gear (14) to rotate, so that with the rotation of said first gear (12) and said second gear (14), said plurality of first axially extending arms (121) periodically levelling with said plurality of second axially extending arms (141) respectively; and a wheeled toy member (30) including a pair of opposite supporting members (321,322) which member when placed on said lower end of said track member (20), is carried by one of said first axially extending arms (121) to one of said second axially extending arms (141), and then is carried to the upper end of said track member (20).

2. A track toy set as claimed in claim 1, further including a plurality of said wheeled toy member (30), said plurality equalling in number the total number of said first axially extending arms (121) and said second axially extending arms (141).

3. A track toy set as claimed in claim 1, wherein said opposite supporting members (321, 322) of said wheeled toy member (30) are formed as the right section and left section of a transverse portion of a T-shaped member (32) whose longitudinal portion is secured on the upper end of said wheeled toy member (30).

4. A track toy set as claimed in claim 1, wherein said first axially extending arm (121) is levelled with said second axially extending arm (141) in the vicinity of the engaged teeth of said first gear (12) and said second gear (14).

5. Toy comprising:

a track member having an upper end and a lower end;

a body member mounted with respect to the track member;

a plurality of gear members rotatably mounted with respect to the body member, each gear member having an axis located above the lower end of said track member and having a plurality of axially extending arms peripherally disposed thereon;

a driving mechanism for rotating said plurality of gear members and a toy member including means for engaging said axially extending arms, said toy member being transported from the lower end of said track member to the upper end thereof when said means for engaging said axially extending arms engage said axially extending arms and said driving mechanism rotates said plurality of gear members.

6. The toy of claim 5, wherein said means for engaging said axially extending arms comprise supporting members which extend at approximately a right angle to the axes of said axially extending arms.

7. The toy of claim 6, wherein each of said plurality of said gear members includes teeth for inter-engagement with other gear members of said plurality of gear members.

8. The toy of claim 6, wherein said plurality of gear members include two gear members which rotate in opposite directions with respect to each other and wherein said toy member is first lifted by one of the axially extending arms from a first gear member and thereafter lifted by an axially extending arm from the second gear member to the upper end said track member.

* * * * *